United States Patent [19]

Goldberg

[11] 4,204,273

[45] May 20, 1980

[54] CONSTRUCTION OF ILLUMINATING RIBBON OF LIGHT BULBS

[76] Inventor: Gerald M. Goldberg, 10501-1 Larwin Ave., Chatsworth, Calif. 91311

[21] Appl. No.: 939,657

[22] Filed: Sep. 5, 1978

Related U.S. Application Data

[63] Continuation of Ser. No. 764,385, Jan. 31, 1977, abandoned.

[51] Int. Cl.[2] ..... F21S 3/00

[52] U.S. Cl. ..... 362/217; 362/238; 362/226; 362/240

[58] Field of Search ..... 362/219, 226, 240, 238

[56] References Cited

U.S. PATENT DOCUMENTS

| | | | |
|---|---|---|---|
| 2,692,375 | 10/1954 | Carson . | |
| 2,920,184 | 1/1960 | Kessler | 362/320 X |
| 3,079,458 | 2/1963 | Hedstrom | 174/117 FF |
| 3,168,617 | 2/1965 | Richter | 174/119 FF |
| 3,322,887 | 5/1967 | Polidori | 339/276 |
| 3,527,933 | 9/1970 | Thummel | 362/226 X |
| 3,894,225 | 7/1975 | Chao . | |
| 3,898,422 | 8/1975 | Fuller et al. . | |

*Primary Examiner*—Peter A. Nelson
*Attorney, Agent, or Firm*—Poms, Smith, Lande & Rose

[57] ABSTRACT

A flexible conductor of strip configuration including a pair of copper conductors laminated between a pair of insulating material layers, one of said layers comprising vinyl having an elastic deformation characteristic capable of taking a temporary set on deformation within its elastic limit and the other layer being of mylar, as assembled thereto a plurality of incandescent light bulbs, each having bare wire leads coated by an electrically conductive grease and means for mounting and retaining the bulbs to the conductor with the leads in electrical contact with the conductor, such means for mounting including portions of the vinyl layer overlying the leads. During assembly of the bulb leads to the conductor, the vinyl layer is pierced and portions are deformed within the elastic limit of the material to form tunnels in which the bulb wire leads are inserted. As the vinyl material reacts under its memory toward its undeformed state, it clamps the wire leads in electrical contact with the conductors and the bulbs in assembled relation to the cable.

3 Claims, 11 Drawing Figures

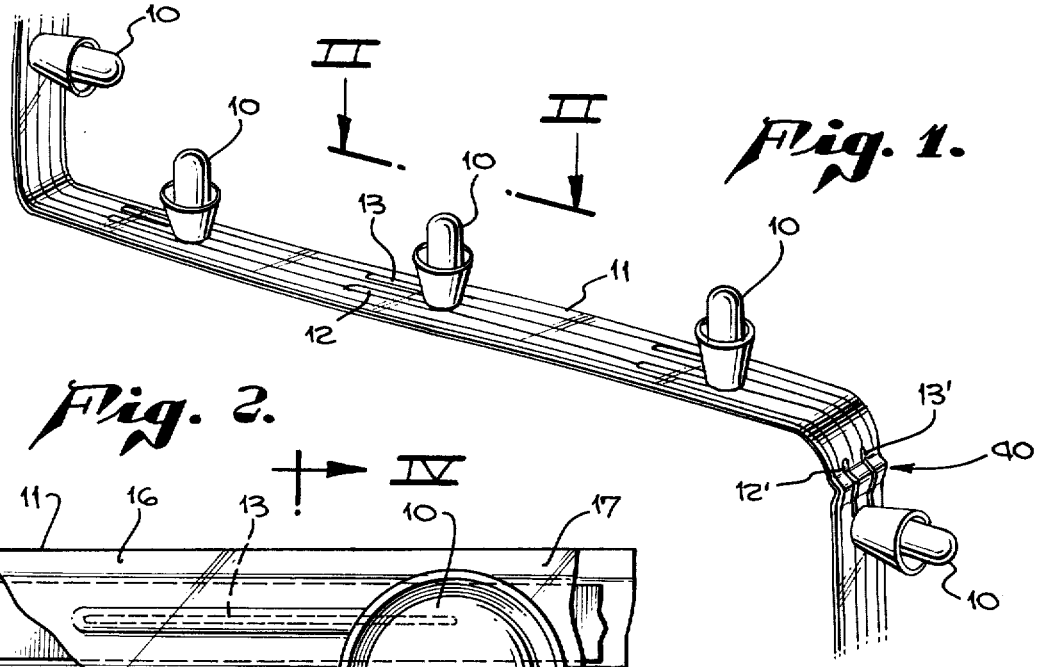
Fig. 1.
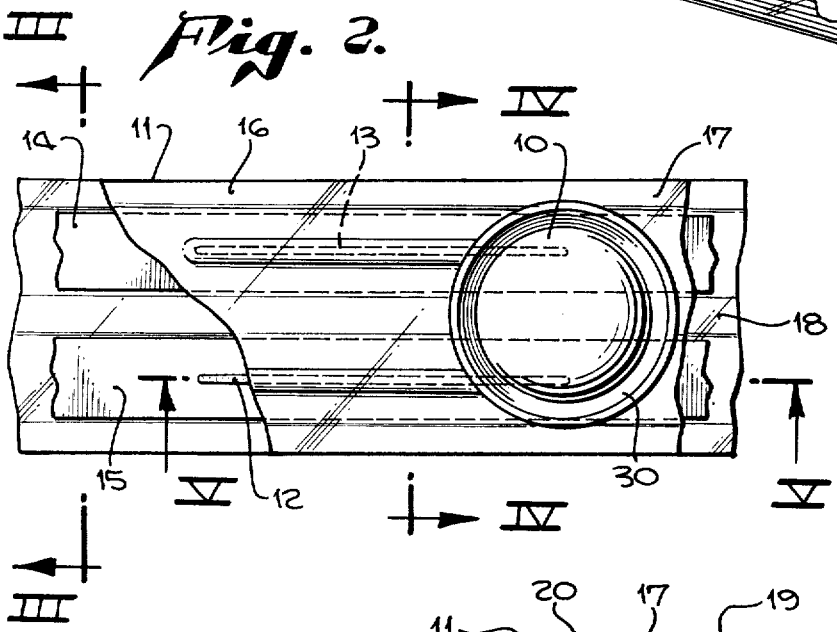
Fig. 2.
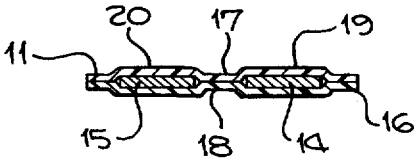
Fig. 3.
Fig. 4.
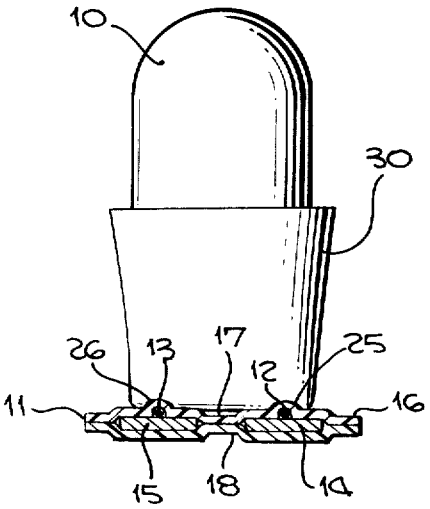
Fig. 5.
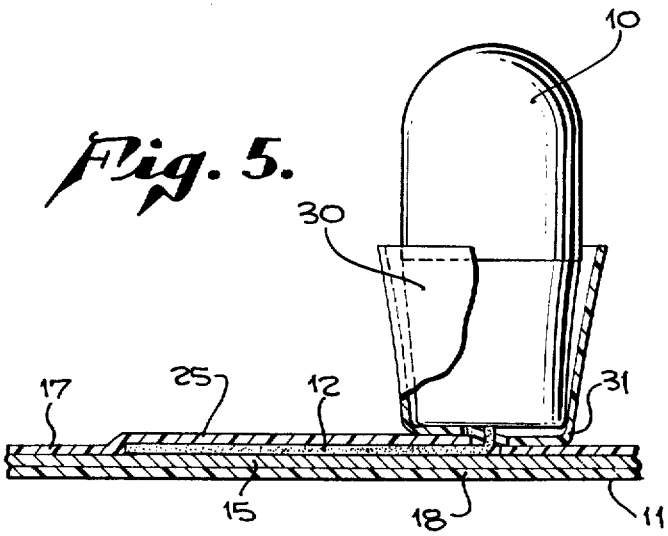

CONSTRUCTION OF ILLUMINATING RIBBON OF LIGHT BULBS

This is a continuation of application Ser. No. 764,385, filed Jan. 31, 1977, and now abandoned.

BACKGROUND OF THE INVENTION

The present invention relates in general to illuminating means and in particular to illuminating means comprising a plurality of miniature or sub-miniature light bulbs assembled in a longitudinal array along a preferably flexible and flat conductor.

In accomplishing various architectural or design concepts in interior and exterior illuminating projects, it has been found that the use of low voltage miniature or sub-miniature incandescent lamps or light bulbs in association with a flexible conductor is highly advantageous. Such light bulb ribbons, or ribbons of light bulbs, may be placed in various geometric designs and decorative arrangements in quite fascile manner if the cable is sufficiently flexible, the light bulbs remain in assembled relation to the cable and the cost of the assembly is maintained at a reasonable level.

It is therefore an object of the present invention to disclose and provide a method of making, and a construction of, a flexible cable and light bulb assembly wherein a plurality of miniature or sub-miniature incandescent light bulbs may be mounted upon a conductor ribbon in an improved and fascile manner to provide a permanent assembly thereof inexpensively and effectively.

It is another object of the present invention to disclose and provide methods and constructions as in the foregoing object wherein the assembly is water proof, the electrical contact between the assembled light bulbs and conductors is optimized and the manner of assembly avoids the need for complicated and expensive assembly techniques.

SUMMARY OF THE INVENTION

Generally stated, the present invention in an illuminating ribbon of light bulb assembly comprises the provision of a conductor cable including a pair of conductive strips enveloped by a non-conductive material, portions at least of which include an elastic material capable of taking a temporary set on elastic deformation thereof within its elastic limit before resuming its undeformed configuration and one or more light bulbs assembled to the cable, each such bulb having a pair of bare wire leads, with the wire leads underlying portions of the elastic material and held thereby in electrical contact with the conductors and the bulb thereby held in assembled relation to the cable.

More specifically, the present invention comprises the provision of a flexible cable and light bulb assembly wherein the flexible cable includes a conductor of strip configuration including a pair of copper conductors laminated between a pair of insulating material layers with first portions of the layers in contact with each other and other portions of the layers in contact only with the conductors, and specifically where one of the layers comprises vinyl material having an elastic deformation characteristic capable of taking a temporary set on deformation within its elastic limit, a plurality of incandescent light bulbs, each having wire leads, and means for mounting the bulbs to the connector with the leads in electrical contact with the conductors, such means for mounting including portions of the vinyl layer overlying the leads.

In accordance with the present method of making the aforedescribed construction, the elastic material portions of the insulating covering are pierced by an appropriate tool to produce a pair of apertures individually aligned to individual ones of the conductors and the elastic material is raised through the insertion of steel pins through the apertures to form tunnels in the elastic material over the conductors. Wire leads of the light bulbs are then inserted into such tunnels and as the elastic material reacts under its memory toward its undeformed configuration, the leads are clamped in electrical contact with the conductors and the bulb is held in assembled relation.

As further contemplated within the present invention, the electrical contact characteristics achieved by the present method and construction may be enhanced through the application of an electrically conductive polymer to the wire leads before they are inserted beneath the elastic material covering. In addition, a collar of electrically non-conductive elastic material may be provided in a tight fit about the lower portions of the light bulbs and have base portions thereof bonded to the cable covering to provide a water tight seal between the assembled bulbs and cable. Also, additional means may be provided for holding the wire leads anb bulbs in assembled relation to the cable through the provision of a crimp across the conductors end leads providing a mechanical interconnection in addition to the retaining effect of the elastic insulation material over the bulb leads.

A more complete understanding of the present invention, as well as a recognition of additional advantages and objects of the present invention, will be afforded to those skilled in the art from a consideration of the following detailed description of a preferred exemplary embodiment of the method and construction of making an assembly of light bulbs upon a flexible cable in accordance with the present invention. Reference will be made to the appended sheets of drawings which will first be described briefly.

BRIEF DESCRIPTION OF THE DRAWINGS

FIG. 1 is a perspective view of a preferred exemplary embodiment of illuminating ribbon of light bulbs assembled in accordance with the method and construction of the present invention;

FIG. 2 is a detail view of the ribbon of FIG. 1 taken therein along the plane II—II;

FIG. 3 is a section view of the ribbon of FIG. 2 taken therein along the plane III—III;

FIG. 4 is a section view of the ribbon of FIG. 2 taken therein along the plane IV—IV;

FIG. 5 is a longitudinal section view of the ribbon of FIG. 2 taken therein along the plane V—V;

DETAILED DESCRIPTION OF A PREFERRED EXEMPLARY EMBODIMENT

Figure 6:
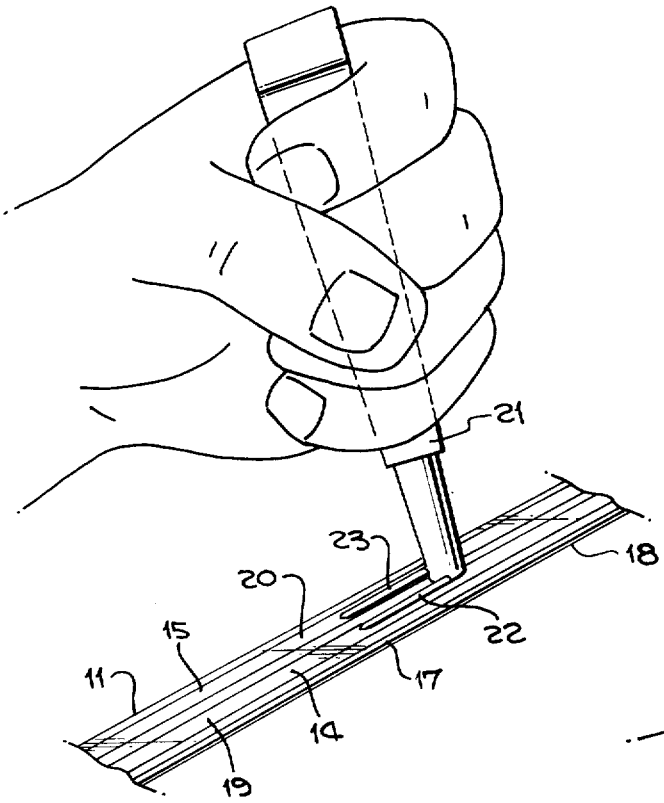
FIG. 6 illustrates an exemplary tool and method for piercing the insulation of an exemplary embodiment of flexible flat cable in accordance with the method of making the illuminating ribbon of light bulbs of FIG. 1 in accordance with the present invention.

A preferred exemplary embodiment of illuminating ribbon of light bulbs in accordance with the method and construction of the present invention is illustrated in FIG. 1. A plurality of light bulbs 10 are shown assembled to an electrical cable 11 in accordance with the method and construction of the present invention. In the exemplary embodiment, each of light bulbs 10 comprises an incandescent bulb of miniature or sub-miniature size, preferably on the order of a 14 volt, 0.08 amperage lamp such as No. 2182 which is a standard bulb in the incandescent light bulb industry. Such bulbs 10 may be purchased with bare wire leads 12 and 13.

Cable 11, in the exemplary embodiment, comprises a flexible flat strip—like conductor including a pair of electrical conductive strips 14 and 15 enveloped in a covering of electrically non-conductive, insulating material 16. Preferably, conductive strips 14 and 15 are of "dead soft" copper and the insulating or covering material of the cable comprises a plastic material having specific characteristics as hereinafter explained.

As particularly contemplated within the present invention, at least portions of the insulating material covering 16 of conductor 11 include an elastic material capable of taking a temporary set on elastic deformation within its elastic limit for at least a short period of time prior to its resuming its initial configuration due to its memory characteristics. I have found that a particularly suitable cable for use in the construction and method of my present invention is manufactured under the trade name "Flex-Strip" by the Ansley Electronics Corporation, a subsidiary of Thomas & Betts Corporation, Doylestown, Pa. Such cable, as illustrated in FIG. 3, comprises a top layer 17 of vinyl laminated over copper strips 14 and 15 to a base layer 18 of mylar. Layers 17 and 18 are in intimate tightly adhering relation to each other in the exemplary Ansley Electronics Corp. "Flex-Strip" flat cable with portions 19 and 20 of the elastically deformable vinyl layer 17 overlying and tightly engaging along upper surfaces of copper conductors 14 and 15, respectively, over the longitudinal extent of cable 11. The vinyl layer, as is characteristic of vinyl, preferably has a large elongation characteristic under elastic deformation, takes a temporary set and then has a maximum recovery toward its original undeformed configuration in a known phenomenon referred to as "memory".

Figure 7:
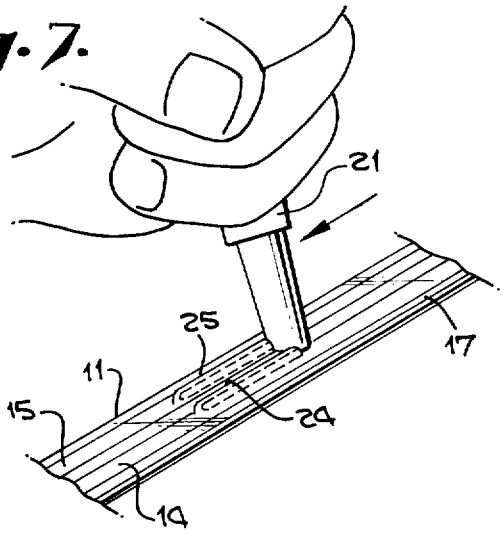
FIG. 7 illustrates the step of elastically deforming portions of the cable covering in accordance with the method of the present invention; to form a pair of spaced tunnels therein.
Figure 8:
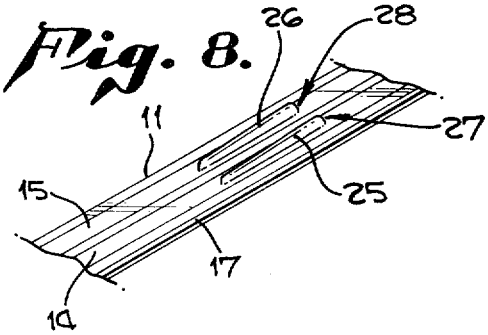
FIG. 8 illustrates the configuration of the exemplary cable when segments thereof have taken a temporary set through elastic deformation within the elastic limit of the material according to the method of the present invention.
Figure 9:
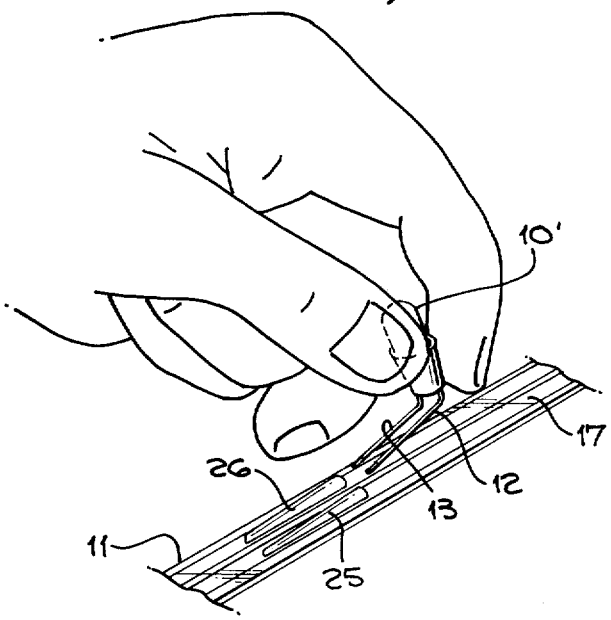
FIG. 9 illustrates the step of positioning an exemplary embodiment of incandescent light bulb with its bare wire leads in position to be assembled to the cable.
Figure 10:
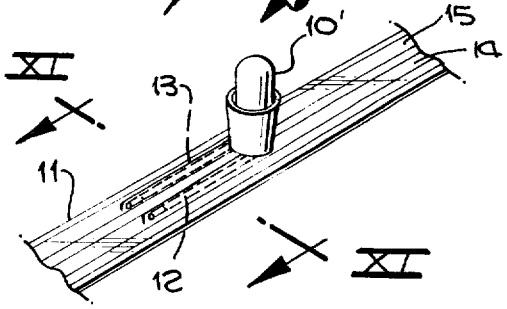
FIG. 10 illustrates the bulb - cable assembly upon initial insertion of the bulb leads in the aforementioned tunnels.
Figure 11:
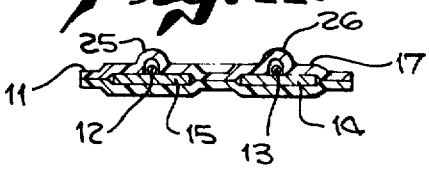
FIG. 11 is a section view through the assembly of FIG. 10 along the plane XI—XI prior to the deformed insulating material reacting under its memory toward its undeformed original configuration to press the wire leads against the conductors and hold the bulb assembled to the cable in accordance with the method and construction of the present invention.

According to the method of the present invention, and as seen in FIG. 6, a hand operated tool, or other suitable apparatus, as tool 21 is provided with a pair of steel pins 22 and 23. I have found that such a tool 21 with pins 22 and 23 may be easily manipulated to pierce the upper portions 19 and 20 of the upper insulating vinyl layer 17 above copper conductors 14 and 15 to produce a pair of aperatures through the insulating covering, and particularly through the elastically deformable vinyl layer 17. The tool 21 is then manipulated, as shown in FIG. 7, in accordance with the present method, to slide pins 22 and 23 beneath the insulating layer 17 to raise segments 24 and 25 of vinyl layer 17 away from the copper conductors 14 and 15 to produce a pair of tunnels 25 and 26, as seen in FIG. 8, adjacent the aperatures 27 and 28. By sizing the steel pins correctly, a temporary set can be produced in the vinyl layer 17 such that tunnels 25 and 26 remain for a short period of time before the vinyl material responds under its memory characteristic and tends to resume its undeformed configuration. If the steel pins are too small in diameter, the tunnels remain insufficiently long to allow easy assembly of the light bulbs as discussed hereinafter. On the other hand, if the steel pins are provided in too large a diameter, the elastic material layer 17 may be stretched beyond its elastic limit and permanently deformed. I have found that a 0.040 inch diameter steel pin used with the "Flex-Strip" cable aforedescribed will give a 7 to 10 second period of time at normal room temperatures during which assembly of the light bulb can be accomplished. As shown in FIG. 9, an individual sub-miniature, low voltage incandescent lamp 10' having bare wire leads 12 and 13 may be positioned over the cable and the wire leads slipped easily into the tunnels 25 and 26 to produce the initial assembly thereof of FIG. 10. On such initial assembly of bulb 10' to cable 11, as seen in FIG. 11, tunnels 25 and 26 still have a temporary set with wire leads 12 and 13 lying against conductors 14 and 15. As the vinyl material reacts under its memory, the tunnels 25 and 26 are restricted and the vinyl elastic material tightly presses leads 12 and 13 against the cable holding the bulb 10 in assembled relation as seen in FIG. 4.

Means are provided for effecting a water tight seal between the light bulbs 10 and cable 11 and, in the exemplary embodiment, as seen in FIGS. 4 and 5, includes the provision of an elastic material collar 30. Collar 30 may be formed from a vinyl tube and sized to fit tightly down about the base of light bulb 10, as seen in FIG. 5, with base portions 31 engaging upon the upper surface of upper layer 17. Collar base portions 31 may be adhesively bonded to the insulating covering 17 through the use of known vinyl to vinyl adhesive bonding means. Collar 30 thus is water sealed to layer 17 and due to its elastic tight fit about lamp 10 forms a force fit water seal between itself and the lamp to effectively water insulate bulb 10 in its assembled relation to cable 11.

Means may be provided in accordance with the present method for improving the electrical contact between the bulb wire leads 12 and 13 and the conductors 14 and 15. I have found that an electrically conductive polymer may be spread about the wire leads before they are positioned, as in FIG. 9, for insertion into the cable tunnels 25 and 26. Such conductive polymers, known as "conductive grease" in the industry not only decrease contact resistance but also inhibit corrosion and fungus. An example of such grease suitable for use in the present illuminating light bulb ribbon construction is sold under the trade name "Ecco Shield C.O." by Emerson & Cuming, Inc. of Colton, Massachusetts. Preferably, the collar 30 is first installed about lamp 10 and then the lamp wire leads are coated with the conductive "grease", insertion tool 21 is used to elastically deform the vinyl insulating layer 17 as illustrated in FIGS. 6 and 7 and then the bulb and collar sub-assembly with greased wires is assembled to the cable as illustrated in FIGS. 9 and 10.

While it is believed that the foregoing method and construction of assembly of low voltage light bulbs 10 to conductor 11 is satisfactory for maintaining the assembly in a permanently assembled relation for most installations, there may be installations where the flexible cable 11 is left free of support to continually flex under ambient conditions of moving air or physical vibrations. In such instances, additional means may be used for holding the wire leads of the bulbs to the conductor cable 11, such means in the exemplary embodiment, and as seen at the right hand end of the ribbon in FIG. 1, may comprise the provision of a crimp, indicated generally at 40, across the cable bending the wire leads 12' and 13' and associated copper conductor 14 and 15 into a somewhat V-shaped configuration.

Having thus described an exemplary construction and method of making an illuminating ribbon of light bulbs in accordance with the present invention, it should be noted by those skilled in the art that various modifications, alterations and adaptations thereof may be made within the scope and spirit of the present invention which is defined by the following claims.

I claim:

1. A flexible cable and light bulb assembly comprising: a flexible conductor of strip configuration including a pair of copper conductors laminated between a pair of insulating material layers with first portions of said layers in contact with each other and other portions of said layers in contact only with said conductors, one of said layers comprising vinyl having an elastic deformation characteristic capable of taking a temporary set on deformation within its elastic limit;

a plurality of incandescent light bulbs, each having a pair of wire leads with free ends said free end penetrating said one of said layers and engaging said conductors; and means for retaining said bulbs to said conductor with said leads free ends held in electrical contact laterally against said conductors, said means for retaining including portions of said vinyl layer overlying said leads, engaging and pressing said free ends laterally against said conductors.

2. An illuminating ribbon of light bulbs comprising:

a cable including a pair of spaced longitudinally extending electrically conductive strips enveloped by separate strip like upper and lower layers of electrically non-conductive material laminated into intimate relation to each other about said conductive strips, one of said strip like layers including an elastic material and, wherein said cable comprises a flexible flat cable, said conductors comprise flat copper strips, and said one of said layers including elastic material comprises a layer of vinyl laminated over said strips to a plastic insulating material comprising the other of said layers;

a plurality of light bulbs spaced along said cable in electrically conductive relation to said conductive strips, one or more of said bulbs having conductor wire leads passed through holes in said one of said layers and in contact laterally against said conductive strips; and means for holding said leads to said conductive strips, said means for holding including portions of said elastic material engaging and elastically pressing said leads due to the memory of said material against said conductive strips.

3. An illuminating ribbon of light bulbs comprising:

a cable including a pair of spaced longitudinally extending electrically conductive strips enveloped by upper and lower layers of electrically non-conductive material in intimate relation to each other about said conductive strips, one of said layers including an elastic material and wherein said cable comprises a flexible flat cable, said conductors comprise flat copper strips, and said layer including elastic material comprises a layer of vinyl laminated over said strips to a plastic insulating material comprising the other of said layers.

a plurality of light bulbs spaced along said cable in electrically conductive relation to said conductive strips, one or more of said bulbs having conductor wire leads penetrating said layer of vinyl and in contact laterally against said conductive strips;

means for holding said leads to said conductive strips, said means for holding including portions of said elastic material engaging and pressing said leads against said conductive strips;

a collar of electrically nonconductive elastic material about said bulb and having portions engaging adjacent portions of said layers; and bonding means for sealing said collar portions to said portions.

* * * * *